United States Patent [19]

Olen

[11] 4,455,150

[45] Jun. 19, 1984

[54] CHEMICALLY ENHANCED COMBUSTION OF WATER-SLURRY FUELS

[76] Inventor: Kenneth R. Olen, 800 Elwood Ave., Port St. Lucie, Fla. 33452

[21] Appl. No.: 524,341

[22] Filed: Aug. 18, 1983

[51] Int. Cl.[3] ..... C10L 1/32

[52] U.S. Cl. ..... 44/51; 149/36; 149/92; 149/70; 149/72; 149/73; 149/105; 149/109.4

[58] Field of Search ..... 44/51; 149/70, 72, 73, 149/36, 92, 105, 109.4

[56] References Cited

U.S. PATENT DOCUMENTS

| | | | |
|---|---|---|---|
| 3,751,473 | 8/1973 | Hill et al. | 149/105 |
| 3,953,259 | 4/1976 | Sayle | 149/105 |
| 4,239,073 | 12/1980 | Reed, Jr. et al. | 149/109.4 |
| 4,302,212 | 11/1981 | Yamamura et al. | 44/51 |

*Primary Examiner*—Charles F. Warren

*Assistant Examiner*—Mrs. Y. Harris-Smith

*Attorney, Agent, or Firm*—John S. Roberts, Jr.

[57] ABSTRACT

A method of enhancing the combustion of solid fuel/-water slurries by the addition of about 100 to 5,000 ppm of a stable water-soluble explosive, which will detonate early in the combustion process, thereby producing a secondary dispersion of fuel particles, and an 80–65% coal/20–35% water composition suitable for secondary dispersion during combustion containing about 100–5,000 ppm of a water-soluble explosive, preferably selected from at least one member of a group consisting of picric acid; alkali picrates, such as ammonium picrate, sodium picrate, potassium picrate, calcium picrate, etc., and heavy metal picrates, such as iron picrate, lead picrate, zinc picrate, etc.; guanidine and nitroguanidine. The addition of the explosive may be made to the water of make up of the slurry or may be added to the formed slurry.

10 Claims, No Drawings

CHEMICALLY ENHANCED COMBUSTION OF WATER-SLURRY FUELS

This invention relates to a method of enhancing the combustion of solid fuel/water slurries by the addition of about 100 to 5,000 ppm of a stable water-soluble explosive, which will detonate early in the combustion process, thereby producing a secondary dispersion of fuel particles, and an 80–65% coal/20–35% water composition suitable for secondary dispersion during combustion containing about 100–5,000 ppm of a water-soluble explosive, preferably selected from at least one member of a group consisting of picric acid; alkali picrates, such as ammonium picrate, sodium picrate, potassium picrate, calcium picrate, etc., and heavy metal picrates, such as iron picrate, lead picrate, zinc picrate, etc.; guanidine and nitroguanidine. The addition of the explosive may be made to the water of make up of the slurry or may be added to the formed slurry.

MATERIAL INFORMATION DISCLOSURE (1) U.S. Pat. No. 894,110 Bloss (2) U.S. Pat. No. 613,980 Eidherr (3) U.S. Pat. No. 4,244,701 Yamashita (4) Morris, T. A., et al., "Micronized Coal as an Alternate Fuel for Oil and Gas Fired Boilers," Proceeding of the *5th International Coal Utilization Exhibition and Conference,* Vol. 5, pp. 7–22, Dec. 7–9, 1982, Houston Tex.

(5) Briceland, C. L., et al., "Combustion Characteristics of Fine-Ground Coal," DOE PETC Contract No. DE-AC22-81PC40269. AR&TD Contractors Review Meeting, Apr. 5–8, 1983, Pittsburgh, PA.

(6) Beer, J. M., et al., "Agglomeration of Char in Coal-Water Slurry Composition," Engineering Foundation Conf. *Combustion of Tomorrow's Fuels,* Nov. 7–12, 1982, Santa Barbara, CA.

(7) Manfred, R. K., et al., "Coal-Water Slurry Combustion Tests," American Power Conference, Apr. 18–20, 1982, Chicago, IL.

(8) Lippman, R., et al., "Dynamics of Exploding Drops," Dept. of Physics and Energy Studies, Adelphi Univ., Garden City, NY.

(9) Kirk-Othmer, *Encyclopedia of Chemical Technology,* 3d Ed., Vol. 9, pp. 581–586, 590–593, John Wiley & Sons, Inc., New York, 1980.

(10) Levenspiel, O., *Chemical Reaction Engineering,* 2d Ed., pp. 357–378, John Wiley & Sons, Inc., New York, 1972.

(11) Timothy, L. D. et al., "Characteristics of Single Particle Coal Combustion," The Nineteenth Symposium (International) Combustion, August 1982, Haifa, Israel.

DESCRIPTION OF THE INVENTION

Solid fuel/liquid mixtures consist of finely ground solid fuel, such as coal, coke, etc., a carrier liquid such as oil, water, alcohol, or a mixture of carrier liquids, and chemicals to improve stability and/or flow or rheological properties. The amount of solids in solid-liquid mixture fuels is restricted by the coal particle size distribution and flow considerations. The first of these limitations represents packing efficiency, where it is necessary to have a distribution of very fine particles to fill in the spaces between larger particles in order to increase coal loading. Flow considerations such as apparent viscosity and the change in viscosity with increasing flow or shear rates more often limits solids loading of the mixtures. For these reasons, for example, in coal-water, coal-alcohol, and coal-water-alcohol mixtures, coal loading is typically 70–75%.

Coal-liquid mixture fuels clearly offer several advantages over bulk and pulverized coal including ease of storage and handling, and the possibility of integrating coal beneficiation into the fuel preparation process. The motivation for coal-liquid mixture fuel development was, in part, due to a sizeable difference between the price of liquid petroleum-based fuels and coal. Coal-oil, coal-oil-water, and coal-water mixture fuels have, with slight equipment modifications, already been used to reduce or eliminate the use of oil in industrial processes and utility boilers. In addition to use as a boiler fuel, coal-liquid mixture fuels are expected to find application in process heating equipment, combustion turbines, and internal combustion engines. As the availability of oil decreases or the price difference between oil and coal increases, coal-water mixtures will be the most economical coal-liquid mixture fuel to replace oil, although other water slurry fuels are possible, including petroleum coke-water and charcoal-water mixtures.

The replacement of oil with coal-water mixture (CWM) fuels is not, however, a simple substitution. Because of differences in combustion characteristics and ash levels, burner and equipment modification are generally required. For example, proper heat balance must be maintained to avoid a derating while firing CWM fuel in a boiler designed for oil-firing. Major loadlimiting factors are the abilities to extract heat in the furnace and boiler convective sections, and maintain gas velocities within permissible limits.

In comparison to oil, higher excess air levels are required to achieve efficient combustion of CWM fuels. Therefore, an inherent limitation to achieving design capacity may be limited fan capacity or convective section tube spacing. In addition, in light of the higher ash content of CWM fuel in comparison to oil, it may be essential to keep tube surfaces absolutely clean to insure efficient heat transfer. Slagging or fouling, the deposition of molten or partially molten and solid ash particles, in the furnace would severely limit heat transfer, thereby preventing operation at design capacity as furnace exit gas temperatures may exceed permissible limits. Safeguards against furnace slagging are selecting a coal with high ash fusion temperatures and achieving high carbon utilization through proper burner design and operation. Fouling may be accommodated with the installation and operation of furnace wall blowers and soot blowers in the convective sections. In boilers having closely-spaced convective sections, it may be necessary to select a coal that has been beneficiated to a very low ash level; i.e., less than 1%.

Deep beneficiation may not, however, be needed to minimize derating as was illustrated in recent pulverized-coal combustion studies (see references 4 and 5). It was found that when burning finely ground coal, the ash particles tended to remain in the gas stream. From the results of these studies, it was reasoned that micronizing the coal prior to combustion would reduce carbon burnout times, ash deposition rates, and ash impingement rates, as compared to those experienced in standard "utility grid" pulverized coal firing. Should it be possible to obtain these benefits on CWM's by micronizing the coal during the preparation of the fuel, the associated reduction in fouling might eliminate the need for extensive coal beneficiation to avoid unit derating.

Using micronized coal in the form of a stable water mixture might be preferred as handling would be facilitated, particle size distribution could be controlled more easily, and lower grinding costs would be incurred.

Additionally, ash deposition rates from CWM flames may not be influenced solely by coal particle size distribution. Several investigations have demonstrated that particle agglomeration takes place on CWM flames (see references 6 and 7). In-flame particle agglomeration, which is apparently a strong function of atomizer droplet size, could be expected to prevent ash particle suspension in the gas stream. Atomizer droplet size is a function of several factors including atomizer design, coal particles size distribution, type and quantity of stability and flow improver additives, apparent viscosity, rheological behavior at high shear rates, fuel temperature, and the amount of energy used to atomize the fuel. Decreasing the severity of agglomeration may be accomplished by finely grinding the coal particles and redesigning the atomizer or increasing the energy input to the atomizer to reduce droplet sizes. In addition to being economically unattractive, this approach may not sufficiently limit agglomeration so as to produce ash particle entrainment in the gas stream. Considering the abrasive nature of CWM fuels, consistently good atomizer performance with continuous boiler operation would also be of concern.

A secondary dispersion of the coal particles as the CWM droplets enter a flame produced several other beneficial effects. Minimizing or eliminating agglomeration exposes more coal particle surface area for combustion and, as a result, flame stability was improved. In addition, both the rate and efficiency of combustion would be increased. Secondary dispersions of this type have been demonstrated with oil-water emulsions and properly prepared coal-oil-water mixture fuels (see reference 8). As these fuels are atomized into a flame front, the light hydrocarbons in the oil vaporize and ignite. As the vapor burns, the temperature of the droplet increases until the boiling point of water is reached, at which time the water flashes to steam exploding the droplet. Water in properly prepared coal-oil-water mixture fuels thereby provides a secondary dispersion of the coal particles. The result is a dramatic reduction in ash deposition rate. A volatile constituent is normally not available in coal-water mixture fuels to produce this secondary dispersion.

The addition of a small amount of an explosive material to coal-water mixture fuels provides the necessary vehicle for a secondary coal particle dispersion. Explosives are chemical compounds that, when properly initiated, produce large volumes of hot gases quickly. Linear reaction rates are typically measured in kilometers per second ($2\text{–}9\times10^3$ m/s), whereas those for the combustion of coal are measured in microns per second ($10^{-6}$ m/s). The most common explosive initiation modes are shock transfer or the application of heat. For safe handling and uniform distribution throughout the fuel, the selected explosive material should be soluble and stable in the carrier water. The candidate explosive must also be thermally unstable at a temperature above the boiling point of water, environmentally acceptable, inexpensive and readily available. In addition, a residue of explosive must be left on the surface of the coal particles after the water is evaporated from the atomized fuel droplets as they enter a flame. Separation of the individual coal particles will occur when the precipitate or residue is detonated by the elevated temperature.

Preferred explosive treating agents for producing a secondary explosion in a CWM are picric acid (2,4,6-trinitrophenol); alkali picrates, such as ammonium picrate, sodium picrate, potassium picrate, calcium picrate, etc., and heavy metal picrates, such as iron picrate, lead picrate, zinc picrate, etc., which are nitroaromatics; nitroguanidine (NQ) and guanidine derivatives which are nitramines. The above compounds are soluble in water (aqueous 20° C.) at values of at least 100–5,000 ppm. The soluble explosive guanidines include the triamino-, nitroamino-, and diethylguanidine.

The amount and type of explosive used may be dependent on compatibility with the chemicals used to establish fuel stability and flow properties. Coal particle size distribution, which is normally specified by the fuel supplier according to proprietary formulae, will also determine the amount of explosive required. Sufficient explosive should be added such that most, if not all, of the coal particle surface is covered with explosive after the water has been evaporated. Since surface area is proportional to the reciprocal of particle diameter, the smaller the coal particles, the greater the demand for explosive. In most cases, 100 to 1,000 ppm of explosive dissolved in the carrier water may be sufficient to produce the desired secondary coal particle dispersion. However, for coal particles having a platlet morphology or very porous structures, considerably more explosive may be required. The maximum concentration, depending on the choice of explosive, may be limited by solubility considerations. A practical maximum explosive concentration is 5,000 ppm or 1.5 grams of explosive per kilogram of fuel. Assuming a 70% coal/30% water mixture, this translates to 1.5 grams of explosive dissolved in 300 grams of water. Operationally feasible are CWM of 65–80% coal and 35–20% water calculated as weight percent.

SOLUBILITY

Of the above-noted compounds, the preferred nitroguanidine (NQ) has a satisfactory solubility illustrative of 0.4 grams in 100 ml of water at 20° C. The preferred aromatic, or picric acid and picrate compounds, have satisfactory solubility for a maximum dosage of 5,000 ppm. Picric acid (PA) is given in Kirk-Othmer, *Encyclopedia of Chemical Technology,* Vol. 9, p. 586 (1980), as 1.2 grams solubility in $H_2O$ at 20° C. grams per 100 grams.

EXAMPLES

Three examples are set out below for a CWM fuel that contains 70% coal by weight and has a density of 1.20 grams per cubic centimeter (gms $cm^{-3}$). In all examples it was calculated that the fuel was introduced into a flame with an atomizer that produced droplets with a mean diameter of 100 microns. In Example 1 the coal particles in the atomized droplets formed spherical agglomerates which burn as single particles. In Example 2 picric acid was added to the CWM prior to atomization. Early in combustion the detonation of the picric acid separates the coal particles that have a mean equivalent spherical diameter of 20 microns. Example 3 considers an ultra fine ground CWM that has mean coal particle sizes of 8 microns and, like Example 2, picric acid has been added to the fuel. In both Examples 2 and 3 the picric acid has not reacted with any of the CWM constituents and precipitates on the surface of the coal particles as the water is evaporated from the atomized fuel droplet. The combustion rates, as estimated by particle burnout times, are compared for the three examples.

In Examples 2 and 3 the amount of picric acid dissolved in the water is 440 ppm and 1100 ppm, respectively. These concentrations correspond to a calculated monolayer of picric acid being precipitated on the coal particle surface. Spherically shaped coal particles without pores and a normal size distribution about the mean particle sizes; i.e., 20 and 8 micron diameters, was utilized in the calculation.

EXAMPLE 1

Agglomeration

A 100 micron diameter CWM droplet introduced into a flame has an initial volume of $523\times10^{-9}$ cubic centemeters ($cm^3$), and at a density of 1.20 gms $cm^{-3}$ a corresponding mass of $627\times10^{-9}$ gms. Since the fuel is 70% coal, the mass of the coal in the droplet is $439\times10^{-9}$ gms. At a coal density of 1.30 gms $cm^{-3}$ the coal in the droplet occupies a volume of $337\times10^{-9}$ $cm^3$, which is equivalent to a sphere with a diameter of about 86 microns.

As a spherical coal particle with a diameter of 86 microns begins to burn, a layer of combustion products, mainly carbon monoxide, quickly forms around the particle. For combustion to continue, oxygen must diffuse through this layer and react with the coal. Since the thickness of the layer is proportional to the size of the particle, combustion under these conditions is limited by mass transport; i.e., the external diffusion of oxygen to the surface of the particle. Accordingly, carbon burnout time is proportional to the radius of the particle squared; i.e., $t_1 \propto R_1^2$ (See Reference 10).

EXAMPLE 2

Explosion Induced Secondary Dispersion

Consider that the detonation of the picric acid early in the combustion process separates that $337\times10^{-9}$ $cm^3$ of coal in the atomized droplet into about 75 spherical particles each having a diameter of 20 microns. Intitially, combustion proceeds as in Example 1 with the formation of a gaseous layer of combustion products around each particle. However, since the particles are small, the gaseous layers are correspondently small and the external diffusion of oxygen no longer limits combustion. Rather the reaction of the oxygen with the coal is limiting combustion; therefore, carbon burnout time is now proportional to the radius of the particle; i.e., $t_2 \propto R_2$ (See Reference 10).

Comparing the carbon burnout times for Examples 1 and 2 indicates that the effect of separating the coal particles through the addition and detonation of picric acid has enhanced combustion by about 180 times.

$$t_1/t_2 \propto R_1^2/R_2 \qquad \text{Equation 1}$$

EXAMPLE 3

Ultra-fine Ground Coal+Explosion Induced Secondary Dispersion

The volume of coal in each atomized droplet now consists of particles having mean spherical diameters of 8 microns. Again, assuming particles of equal size, the detonation of the picric acid, separates the original coal volume into about 1200 particles. As in Example 2, combustion is limited only by the reaction of the oxygen with the coal and carbon burnout time is proportional to the particles radius ($t_3 \propto R_3$). Comparing the carbon burnout times for Examples 2 and 3 indicates that combustion rate is increased by 2.5 times due to the finer grinding of the coal; i.e., $$t_2/t_3 \propto R_2/R_3 \qquad \text{Equation 2}$$

However, comparing the combined effects of the fine grind and the detonation of the picric acid; i.e., Examples 1 and 3, shows about a 450 times enhancement in combustion; i.e., $$t_1/t_3 \propto R_1^2/R_3 \qquad \text{Equation 3}$$

About two orders of magnitude enhancement in combustion are noted from the combined effects of finer grinding and explosion induced secondary dispersion.

I claim:

1. A method of enhancing the combustion of solid fuel/water mixtures by the addition of about 100–5,000 ppm of a stable water-soluble explosive, said explosive being selected from at least one member of a group consisting of picric acid; alkali picrates, such as ammonium picrate, sodium picrate, potassium picrate, calcium picrate; and heavy metal picrates, such as iron picrate, lead picrate, zinc picrate; triaminoguanidine; nitroaminoguanidine; diethylguanidine; and nitroguanidine, which will detonate early in the combustion process, thereby producing a secondary dispersion of the fuel particles.

2. The method of claim 1 wherein the explosive is picric acid (2,4,6-trinitrophenol).

3. The method of claim 1 wherein the explosive is selected from ammonium picrate and sodium picrate.

4. The method of claim 1 wherein the explosive is nitroguanidine.

5. The method of claim 1 wherein the explosive is triaminoguanidine.

6. An essentially 80 to 65% coal/20 to 35% water composition suitable for secondary dispersion in a combustion composition containing about 100 to 5,000 ppm of a water-soluble explosive selected from at least one member of a group consisting of picric acid; alkali picrates, such as ammonium picrate, sodium picrate, potassium picrate, calcium picrate; and heavy metal picrates, such as iron picrate, lead picrate, zinc picrate; triaminoguanidine, nitroaminoguanidine, diethylguanidine, and nitroguanidine.

7. The composition of claim 6 wherein the explosive is picric acid.

8. The composition of claim 6 wherein the explosive is selected from ammonium picrate and sodium picrate.

9. The composition of claim 6 wherein the explosive is nitroguanidine.

10. The composition of claim 6 wherein the explosive is selected from triaminoguanidine, nitroaminoguanidine, and diethylguanidine.

* * * * *